US006298692B1

(12) United States Patent
Kuroda et al.

(10) Patent No.: US 6,298,692 B1
(45) Date of Patent: Oct. 9, 2001

(54) KNITTING INSTRUMENTALITIES FOR A KNITTING MACHINE AND METHOD OF FORMING SAME

(75) Inventors: Kazuaki Kuroda; Isao Koyama; Yuji Kawase, all of Wakayama (JP)

(73) Assignee: Fukuhara Needle Co., Ltd., Wakayama (JP)

( * ) Notice: Subject to any disclaimer, the term of this patent is extended or adjusted under 35 U.S.C. 154(b) by 0 days.

(21) Appl. No.: 09/379,064

(22) Filed: Aug. 23, 1999

(30) Foreign Application Priority Data

Aug. 24, 1998 (JP) ..... 10-236762

(51) Int. Cl.[7] ..... D04B 35/02
(52) U.S. Cl. ..... 66/123; 66/116
(58) Field of Search ..... 66/116, 119, 120, 66/121, 122, 123, 124, 90, 104

(56) References Cited

U.S. PATENT DOCUMENTS

| | | | | |
|---|---|---|---|---|
| 1,184,526 | | 5/1916 | Harley . | |
| 1,221,806 | | 4/1917 | Scott . | |
| 3,464,237 | | 9/1969 | Kohorn . | |
| 3,712,082 | | 1/1973 | Kohorn . | |
| 3,748,875 | | 7/1973 | Slof et al. . | |
| 3,874,199 | | 4/1975 | Mayer et al. . | |
| 3,875,767 | | 4/1975 | Kopal et al. . | |
| 3,943,732 | * | 3/1976 | Kopal et al. | 66/123 |
| 3,994,145 | | 11/1976 | Stolz . | |
| 4,036,036 | | 7/1977 | Ashmead et al. . | |
| 4,068,500 | | 1/1978 | Kohorn . | |
| 4,089,192 | | 5/1978 | Kohorn . | |
| 4,452,053 | | 6/1984 | Egbers et al. . | |
| 4,625,527 | | 12/1986 | Fukuhara . | |
| 4,681,150 | | 7/1987 | Fukuhara . | |
| 5,154,069 | * | 10/1992 | Speetjens et al. | 66/121 |
| 5,901,582 | * | 5/1999 | Hennig et al. | 66/123 |
| 6,122,938 | * | 9/2000 | Henning et al. | 66/123 |

FOREIGN PATENT DOCUMENTS

| | | |
|---|---|---|
| 2063724 | 7/1971 | (DE) . |
| 1760336 | 1/1972 | (DE) . |
| 24 08 567 | 9/1975 | (DE) . |
| 25 37 502 | 3/1976 | (DE) . |
| 835365 | 9/1938 | (FR) . |
| 75 02218 | 1/1975 | (FR) . |
| 945027 | 12/1963 | (GB) . |
| 1333568 | 10/1973 | (GB) . |
| 1 488 605 | 10/1977 | (GB) . |
| 43152/1974 | 11/1974 | (JP) . |

* cited by examiner

*Primary Examiner*—Danny Worrell
(74) *Attorney, Agent, or Firm*—Alston & Bird LLP

(57) ABSTRACT

A knitting instrumentality for use in a knitting machine and method of forming the same is provided and includes an elongate body member (10, 110, 210) stamped from sheet metal (11, 111, 211) in a predetermined shape and having a fine concave-and-convex pattern (12, 113, 114, 215) formed in the side faces thereof to reduce the contact area of such knitting instrumentality when placed in the knitting machine to reduce the static frictional forces thereon.

6 Claims, 2 Drawing Sheets

KNITTING INSTRUMENTALITIES FOR A KNITTING MACHINE AND METHOD OF FORMING SAME

FIELD OF THE INVENTION

The present invention relates generally to knitting machines and more particularly to knitting instrumentalities for such knitting machines, in particular circular knitting machines and method of forming such knitting instrumentalities.

BACKGROUND OF THE INVENTION

Knitting machines, and in particular circular knitting machines, employ knitting instrumentalities to produce the knitted fabric. In a circular knitting machine, a rotating needle cylinder has a multiplicity of vertical grooves in the outer periphery formed by insert pieces which are stationary or fixed. These vertical grooves receive latch needles, intermediate jacks, patterning jacks and possibly other movable knitting instrumentalities for high speed reciprocation. A lubricating oil is sprayed in mist form onto these knitting instrumentalities to ensure smooth and uninterrupted reciprocation.

However, as knitting speed increases, these knitting instrumentalities tend to adhere to the insert pieces causing the lubricating oil to be expelled from the grooves and the movable knitting instrumentalities to move sluggishly. An abnormal load is applied to the knitting instrumentalities, particularly the butts of the latch needles and, if the condition persists, such abnormal loads frequently result in breakage of the knitting instrumentalities. Such breakage may cause a chain reaction of breakage of other knitting instrumentalities or peripheral parts of the knitting machine.

Attempts have been made to solve this problem with some success, but at substantially increased manufacturing costs because of the complicated processes required to produce the knitting instrumentalities. One example of such movable knitting instrumentalities is disclosed in Japanese Utility Model Laid-Open No.560-127387 (1985). Such knitting instrumentalities are provided with cutouts on opposite side faces with the cutouts on one face being positioned alternately with the cutouts on the other face. Another example is found in Japanese Utility Model Publication H-43419 (1989) in which the movable knitting instrumentalities are provided with projections on their side faces and bottoms.

SUMMARY OF THE INVENTION

With the foregoing in mind, it is an object of the present invention to provide knitting instrumentalities which are easy and less expensive to manufacture in large quantities while maintaining stable quality and which obviate the deficiencies and disadvantages of prior knitting instrumentalities.

This object of the present invention is accomplished by providing knitting instrumentalities that may be manufactured by stamping such instrumentalities from sheet metal in which a fine concave-and convex pattern has been formed to reduce the frictional forces on such knitting instrumentalities and substantially eliminate the tendency thereof to adhere to the insert pieces. In accordance with the present invention, such knitting instrumentalities include both movable and fixed elements capable of being formed by a metal stamping operation and which have surfaces rubbing against other surfaces. Examples of such movable elements are latch needles, intermediate jacks, patterning jacks, etc. and of such fixed elements are insert pieces, etc. Further, examples of such fine concave-and-convex patterns include multiple spaced-apart indentations on at least one surface of the knitting instrumentalities; several continuously formed indentations in at least one surface thereof; an undulating or sinuous shape for at least a portion of the length of the instrumentality; and a cross-sectional shape having thick and thin portions.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
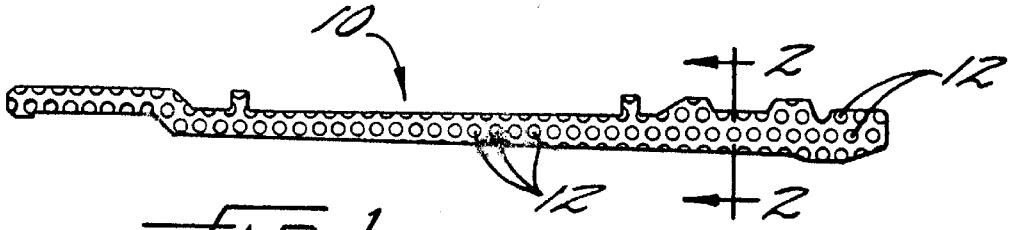
FIG. 1 is a side elevational view of a knitting instrumentality, i.e. a patterning jack, formed in accordance with the present invention.

Referring now more specifically to the drawings and particularly to FIG. 1, there is illustrated a knitting instrumentality, generally indicated at 10, in the form of a patterning jack. The knitting instrumentality 10 is formed of sheet metal 11 and is preferably formed by a stamping process by which large quantities can be produced easily and relatively inexpensively while maintaining stable quality.

Figure 2:
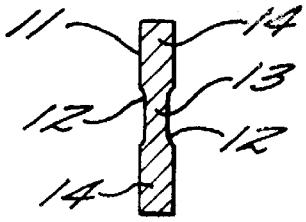
FIG. 2 is an enlarged sectional view taken substantially along line 2—2 in FIG. 1.

As illustrated in FIGS. 1 and 2, the knitting instrumentality 10 is provided with a fine pattern of concave-and-convex areas in the form of indentations 12. Indentations 12 are spaced apart with certain intervals therebetween, such as 0.5 mm for example. Indentations 12 are preferably concave polygons, such as triangles, squares, rectangles, etc. or of any other desired shape, such as dimples on a golf ball.

Indentations 12 may be formed on only one side of the knitting instrumentality 10 but are preferably formed on both sides thereof. Indentations 12 may be formed in the sheet metal 11 from which knitting instrumentality 10 is stamped, by passing the same through the nip of a pair of rolls having projections on the surface thereof corresponding to the desired pattern of indentations 12.

The pattern of concave-and-convex areas result in thick and thin portions in the knitting instrumentality 10. In the knitting instrumentality 10, the indentations 12 define the thin portions 13 and the intervals between the indentations 12 define the thick portions 14. The difference between the thick portion 14 and the thin portion 13 is preferably between about 0.01 mm and about 0.05 mm and most preferably about 0.02 mm.

Figure 3:
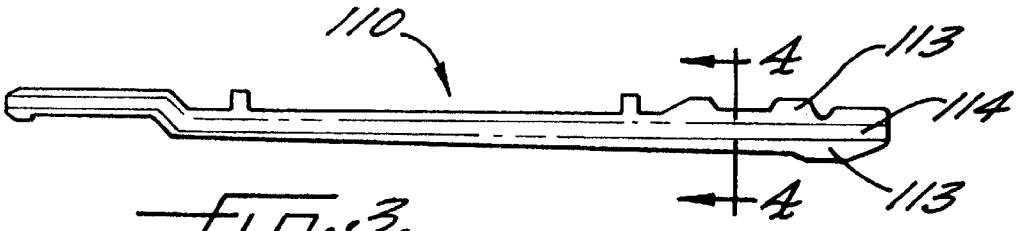
FIG. 3 is a side elevational view similar to FIG. 1 of another embodiment of a knitting instrumentality of the present invention.
Figure 4:
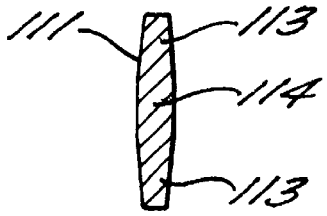
FIG. 4 is an enlarged sectional view taken substantially along line 4—4 in FIG. 3.

Referring now to FIGS. 3 and 4, in which like reference characters with the prefix "1" added are used to refer to like elements, there is illustrated a knitting instrumentality, generally indicated at 110, in the form of a patterning jack. Knitting instrumentality 110 is likewise formed of sheet metal 111 and is produced by a metal stamping operation. In cross-section, knitting instrumentality 110 has a thick center portion 114 and relatively thin outer or end portions 113. The difference in thickness between portions 113 and 114 is preferably approximately 0.02 mm. The cross-sectional shape of knitting instrumentality 110 is preferably formed by passing the sheet metal 111 through the nip of a pair of rolls (not shown), the surfaces of which have profiles corresponding to the desired cross-sectional shape.

Figure 5:
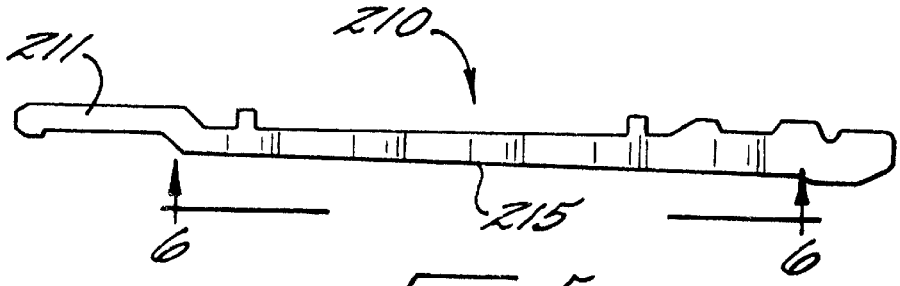
FIG. 5 is a side elevational view similar to FIGS. 1 and 3 of a further embodiment of a knitting instrumentality of the present invention.
Figure 6:
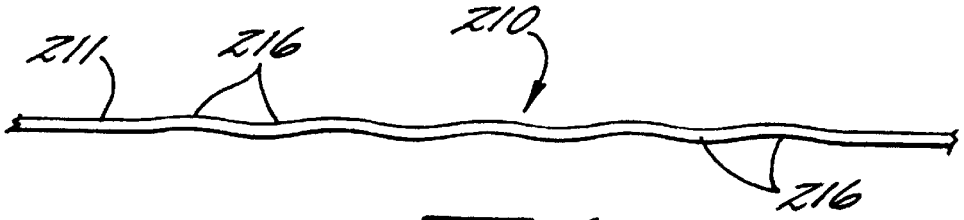
FIG. 6 is an elevational view of the knitting instrumentality of FIG. 6 looking in the direction of the arrows 6—6 in FIG. 6.

Referring now to FIGS. 5 and 6, in which like reference characters with the prefix "2" added are used to refer to like elements, there is illustrated a knitting instrumentality 210, in the form of a patterning jack. Knitting instrumentality 210 is also formed of sheet metal 211 and has a medial or trunk portion 215 thereof formed in an undulating or sinuous shape longitudinally thereof. As illustrated, there are five (5) undulations 216 which are formed by pressing the stamped knitting instrumentality between upper and lower dies (not shown). In use, only the apogees of the undulation will contact the inserts and therefore the area of contact is substantially reduced. The reduced contact area permits lubricating oil to be supplied into the grooves between the inserts and other knitting instrumentalities 10, 110 or 210 so that the movable knitting instrumentalities can move smoothly. Heat generation is also reduced, as is abrasion on the butts of the knitting instrumentalities, thereby prolonging the useful life of the knitting instrumentalities.

Figure 7:
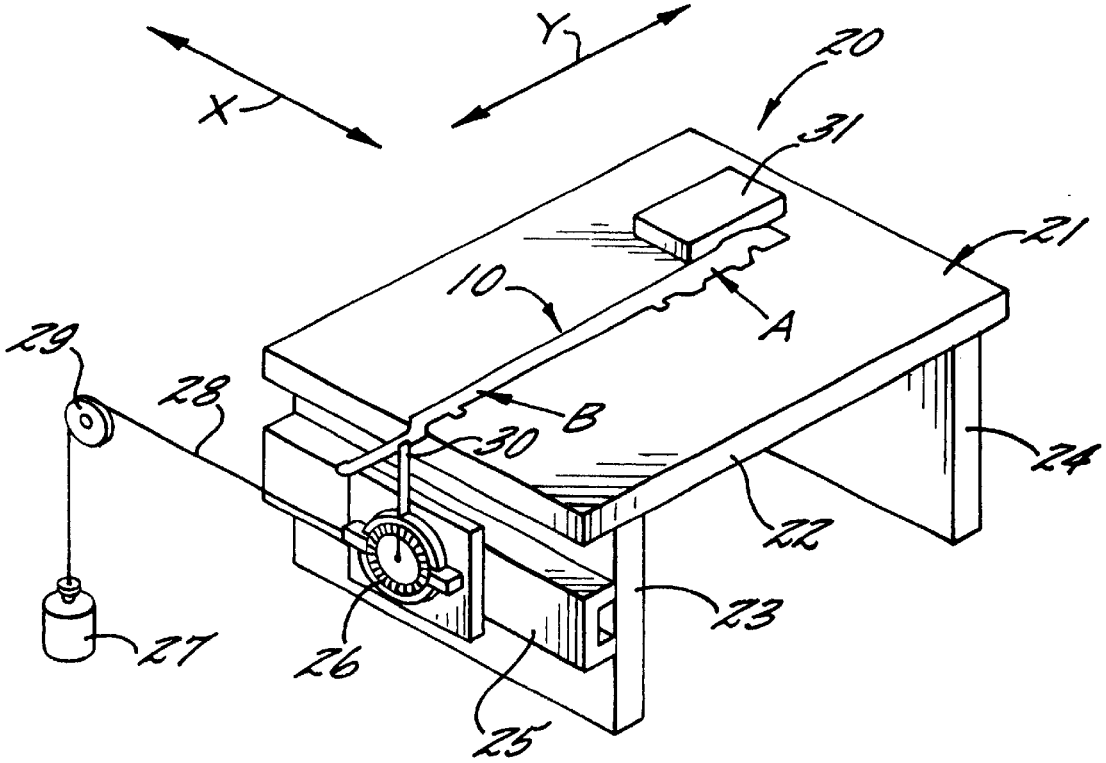
FIG. 7 is a perspective view of a friction resistance apparatus used for testing and evaluating the knitting instrumentalities of the present invention.

The knitting instrumentalities 10, 110 or 210 of the present invention may be evaluated by a resistance tester 20 (FIG. 7) which measures the static frictional forces on the knitting instrumentalities 10, 110, or 210 and, for comparison purposes, conventional knitting instrumentalities. The tester 20 includes a table, generally indicated at 21, having a top 22 and legs 23 and 24. Leg 23 has a horizontal guide 25 mounted thereon, which in turn mounts a spring scale 26 for sliding movement therealong. A weight 27 is connected to spring scale 26 by a line 28 trained about a pulley 29 to bias or move the spring scale 26 to the left as seen in FIG. 7 along an X axis.

A wand 30 extends upwardly from the top of the spring scale 26 and engages a knitting instrumentality 10, 110, or 210 or a conventional knitting instrumentality (not shown). A reinforcing plate 31 is mounted on table top 22 in position to engage the opposite end portion of the knitting instrumentality 10, 110 and 210. Plate 31 serves as a fulcrum about which the instrumentality pivots when the weight 27 is released and moves the spring scale 26 to the left for a predetermined distance and as a stop to stop pivoting movement of the knitting instrumentality at the predetermined distance from the starting position.

In conducting this evaluation, ten knitting instrumentalities 10, 110 and 210 of the present invention and ten conventional knitting instrumentalities of the same shape were selected. The table top 22 was first sprayed with lubricating oil and then a knitting instrumentality was placed thereon in the starting position along a Y axis (shown in FIG. 7) and the knitting instrumentality is then moved in a reciprocating sliding manner twenty (20) times along the Y axis while the knitting instrumentality is pressed downwardly at points A and B by the person conducting the test. The spring scale 26 is then moved to the right until the wand 30 engaged the right side edge of the knitting instrumentality and the weight 27 is released and permitted to fall freely until the knitting instrumentality is stopped by plate 31. The scale 26 is then read and the amount shown thereon is recorded. Table 1 below lists the results recorded in tests on the ten conventional knitting instrumentalities and the ten knitting instrumentalities 10 (Example 1 in Table 1), the ten knitting instrumentalities 110 (Example 2 in Table 1) and the ten knitting instrumentalities 210 (Example 3 in Table 1).

TABLE 1

| | 1 | 2 | 3 | 4 | 5 | 6 | 7 | 8 | 9 | 10 | Unit: g Average |
|---|---|---|---|---|---|---|---|---|---|---|---|
| Conventional Product | 55 | 85 | 85 | 60 | 77 | 93 | 64 | 64 | 52 | 70 | 70.5 |
| Example 1 | 20 | 8 | 16 | 5 | 11 | 35 | 28 | 11 | 16 | 13 | 16.3 |
| Example 2 | 40 | 20 | 20 | 29 | 12 | 5 | 17 | 16 | 26 | 11 | 19.6 |
| Example 3 | 21 | 20 | 17 | 3 | 15 | 14 | 15 | 14 | 10 | 7 | 13.9 |

As is readily apparent, the knitting instrumentalities 10, 110 and 210 of the present invention are subject to significantly reduced static frictional forces compared to the conventional knitting instrumentalities.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A knitting instrumentality for use in a knitting machine comprising an elongate member formed of sheet metal and having a predetermined length, a narrow width and a thickness less than the width thereof defining opposite side faces adapted to be placed in frictional contact with another surface on the knitting machine in use, at least one of said side faces having dimples therein defining thick and thin portions in at least a medial portion longitudinally thereof to reduce the area of frictional contact of said knitting instrumentality when placed in the knitting machine.

2. A knitting instrumentality according to claim 1 wherein said dimples comprise multiple indentations in said elongate member at certain spaced intervals.

3. A knitting instrumentality according to claim 1 wherein said dimples are formed in both side faces of said elongate member.

4. A knitting instrumentality for use in a knitting machine comprising an elongate member formed of sheet metal and having a predetermined length, a narrow width and a thickness less than the width thereof defining opposite side faces adapted to be placed in frictional contact with another surface on the knitting machine in use, both of said side faces of said elongate member having a thick center portion and thin end portions on opposite sides of the center portion, said thick and thin portions extending longitudinally of said elongate member.

5. A method of forming a knitting instrumentality for use in a knitting machine comprising the steps of stamping an elongate member from sheet metal of predetermined size and shape, and forming a pattern of dimples in at least one side face of said elongate member to reduce the area of said elongate member that will frictionally contact another surface on the knitting machine.

6. A method of forming a knitting instrumentality for use in a knitting machine comprising the steps of stamping an elongate member from sheet metal of predetermined size and shape, and forming a pattern of a thick center portion and thin end portions on opposite sides of the center portion on both side faces of said elongate member, said thick and thin portions extending longitudinally of said elongate member, to reduce the area of said elongate member that will frictionally contact another surface on the knitting machine.

* * * * *